US008083007B2

(12) United States Patent
Inagaki et al.

(10) Patent No.: US 8,083,007 B2
(45) Date of Patent: Dec. 27, 2011

(54) ELECTRIC POWER TOOL HAVING SPEED REDUCTION MECHANISM

(75) Inventors: Kenichiro Inagaki, Hikone (JP); Fumiaki Sekino, Hikone (JP); Yutaka Yamada, Osaka (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 255 days.

(21) Appl. No.: 12/382,780

(22) Filed: Mar. 24, 2009

(65) Prior Publication Data

US 2009/0255361 A1 Oct. 15, 2009

(30) Foreign Application Priority Data

Apr. 10, 2008 (JP) ..... 2008-102841

(51) Int. Cl.
*G05G 5/08* (2006.01)

(52) U.S. Cl. ..... 173/217; 173/216; 173/176; 173/179

(58) Field of Classification Search ..... 173/217, 173/216, 176, 179
See application file for complete search history.

(56) References Cited

U.S. PATENT DOCUMENTS

| | | | | |
|---|---|---|---|---|
| 3,710,873 | A * | 1/1973 | Allen | 173/176 |
| 4,487,270 | A * | 12/1984 | Huber | 173/176 |
| 4,493,223 | A * | 1/1985 | Kishi et al. | 74/371 |
| 5,056,607 | A * | 10/1991 | Sanders | 173/48 |
| 5,083,620 | A * | 1/1992 | Fushiya et al. | 173/217 |
| 5,277,527 | A | 1/1994 | Yokota et al. | |
| 5,339,908 | A | 8/1994 | Yokota | |
| 5,361,853 | A * | 11/1994 | Takamura et al. | 173/217 |
| 5,738,177 | A * | 4/1998 | Schell et al. | 173/178 |
| 6,186,709 | B1 | 2/2001 | Hsu | |
| 6,536,536 | B1 * | 3/2003 | Gass et al. | 173/2 |
| 6,836,614 | B2 * | 12/2004 | Gilmore | 388/811 |
| 6,918,449 | B2 * | 7/2005 | Shinagawa et al. | 173/2 |
| 6,971,456 | B2 * | 12/2005 | Yamada et al. | 173/217 |
| 2004/0188233 | A1 | 9/2004 | Breitenmoser | |
| 2009/0071673 | A1 * | 3/2009 | Zhong et al. | 173/216 |

FOREIGN PATENT DOCUMENTS

DE 199 19 115 11/2000

(Continued)

OTHER PUBLICATIONS

The Japanese Office Action dated Dec. 15, 2009 and English summary thereof.

*Primary Examiner* — Brian D Nash
(74) *Attorney, Agent, or Firm* — Bacon & Thomas, PLLC

(57) ABSTRACT

An electric power tool includes a motor, a speed reducer unit arranged to deliver the rotational power of the motor and provided with gears, a housing arranged to accommodate the motor and the speed reducer unit, and a speed changing unit for changing a gear reduction ratio of the speed reducer unit. The speed changing unit is arranged in such a position as to be operable outside the housing. The speed changing unit includes an operation lever slidingly operable in a speed changing direction when pushed, an operation detector unit for detecting the operation lever to control electric power supplied to the motor, a shift unit for changing the gear reduction ratio of the speed reducer unit in response to sliding movement of the operation lever, and a slide restraint unit for restraining the sliding operation of the operation lever until the operation detector unit detects the operation lever.

19 Claims, 22 Drawing Sheets

FOREIGN PATENT DOCUMENTS

| | | |
|---|---|---|
| FR | 2 526 348 | 11/1983 |
| JP | S61-288909 | 12/1986 |
| JP | S63-185589 | 8/1988 |
| JP | H05-073343 | 10/1993 |
| JP | H05-80611 | 11/1993 |
| JP | 07-205050 | 8/1995 |
| JP | 2006-150518 | 6/2006 |
| WO | 2007/025322 | 3/2007 |

* cited by examiner

FIF. 8A
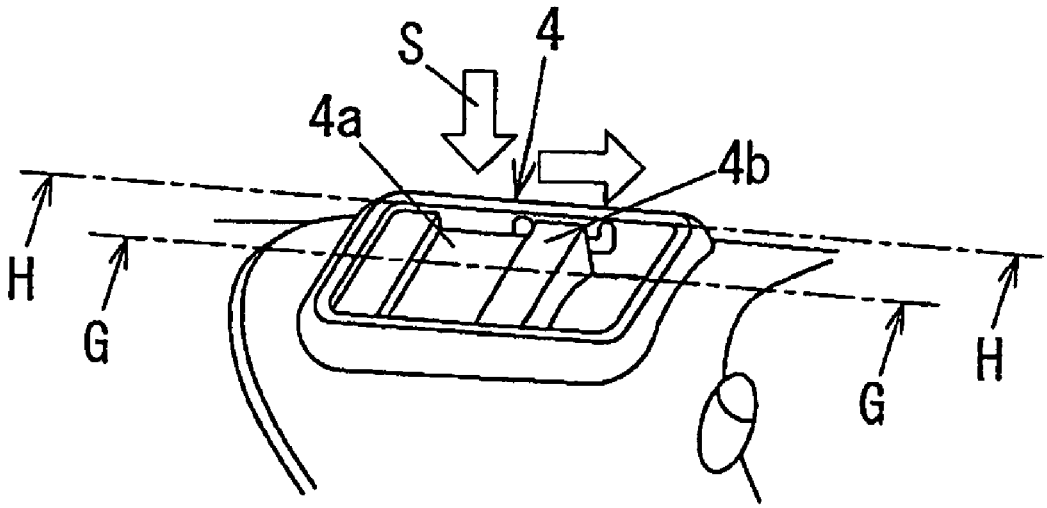
FIG. 8B
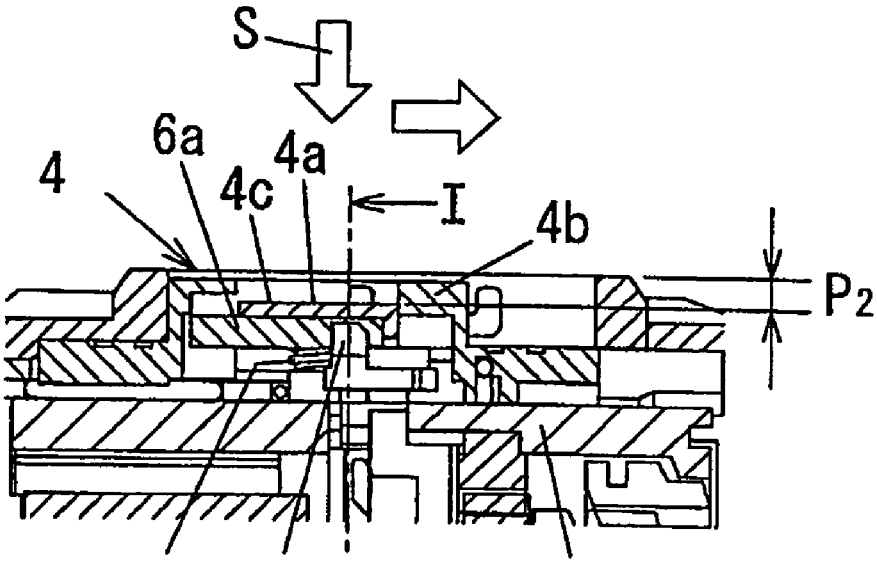

ELECTRIC POWER TOOL HAVING SPEED REDUCTION MECHANISM

FIELD OF THE INVENTION

The present invention relates to an electric power tool, such as a drill driver, a disc saw or the like, which has a speed changing function performed by a speed reduction mechanism.

BACKGROUND OF THE INVENTION

In general, there are known electric power tools that have a speed changing function with a view to enhance work efficiency (see, e.g., Japanese Patent Laid-open Publication No. 63-101545).

One example of the electric power tools is shown in FIG. 15. This electric power tool includes a motor 101 as a driving power source, a speed reducer unit 102 for delivering the rotational power of the motor 101 at a reduced speed, a drive unit (not shown) for delivering the rotational power of the speed reducer unit 102 to a tip end tool, a resin-made housing 104 provided with a handle portion 104*a* and arranged to contain the motor 101 and the speed reducer unit 102 therein, an operation lever 105 and a shift unit 105*a*, both of which serve as a speed changing mechanism for changing the gear reduction ratio of the speed reducer unit 102, the operation lever 105 being arranged in a position where it can be operated outside the housing 104, a power switch 106 installed in the handle portion 104*a* for switching on and off the power supply of the motor 101, and a battery pack 107 engaged with the housing 104 for supplying electric power to the motor 101.

As shown in FIGS. 16A and 16B, the operation lever 105 is designed to convert the tool operation state to a low-speed high-torque state in a high load condition (when the work load is heavy) but to a high-speed low-torque state in a low load condition (when the work load is light). This makes it possible for the electric power tool to perform a desired tightening task depending on the work load, thereby increasing the efficiency of work.

In case the work load varies in the midst of work, the operation lever 105 may be operated during the work to change the gear reduction ratio. This may sometimes cause trouble to the electric power tool. More specifically, if the gear reduction ratio is changed with the operation lever 105 during the course of work, namely if the gear 102*a* of the speed reducer unit 102 is shifted when in rotation, the mutually engageable gears may make contact with each other during their rotation and may be worn or damaged. This may be a cause of trouble in the electric power tool. The conventional solution to this problem is to increase the strength of gears, thereby preventing occurrence of trouble. In this case, however, the gears need to be made of high strength metal or formed into a big size, which leads to a problem of high cost and increased weight.

SUMMARY OF THE INVENTION

In view of the above, the present invention provides an electric power tool capable of making it impossible to perform a speed changing operation until the pushing operation of an operation lever is detected, preventing itself from suffering from trouble which would otherwise occur due to the wear or damage of gears of a speed reducer unit caused by the speed changing operation performed during the course of work, enjoying enhanced reliability, reducing the strength required in the gears and assuring reduced cost and weight.

The present invention further provides an electric power tool capable of making it possible to easily construct a slide restraint unit through the use of an operation lever and a housing, assuring increased operability, reliably restraining movement of the operation lever prior to a speed changing operation, preventing an erroneous operation which would otherwise occur when the operation lever is inadvertently touched, increasing the detection accuracy without having to use sensors in plural numbers, preventing wear of a detection member while prolonging the life span thereof, and preventing damage of precision electronic parts such as a sensor or a switch arranged below the operation lever even when a falling impact force or the like is applied to the operation lever.

In accordance with an aspect of the present invention, there is provided an electric power tool including: a motor as a driving power source for generating rotational power; a speed reducer unit arranged to deliver the rotational power of the motor and provided with two or more gears; a driving unit arranged to deliver the rotational power from the speed reducer unit to a tip end tool; a housing arranged to accommodate the motor, the speed reducer unit and the driving unit therein and provided with a handle portion; and a speed changing unit for changing a gear reduction ratio of the speed reducer unit, the speed changing unit arranged in such a position as to be operable outside the housing, wherein the speed changing unit comprises an operation lever slidingly operable in a speed changing direction when pushed, an operation detector unit for detecting the operation lever to control electric power supplied to the motor, a shift unit for changing the gear reduction ratio of the speed reducer unit in response to sliding movement of the operation lever, and a slide restraint unit for restraining the sliding operation of the operation lever until the operation detector unit detects the operation lever.

With this configuration, the slide restraint unit restrains the sliding operation of the operation lever and makes it impossible to perform a speed changing operation until the pushing operation of the operation lever is detected by the operation detector unit and until the electric power supplied to the motor is controlled to obtain the revolution number corresponding to the gear reduction ratio. This makes it possible to prevent the electric power tool from suffering from trouble which would otherwise occur due to the wear or damage of gears of the speed reducer unit caused by the speed changing operation performed during the course of work.

The slide restraint unit may include a projection portion provided in one of mutually facing surfaces of the operation lever and the housing and a guide portion provided in the other surface, the projection portion and the guide portion being configured in such a manner as to restrain sliding movement of the operation lever in the speed changing direction when the push lever is in a non-pushed position but permit the sliding movement of the operation lever in the speed changing direction when the push lever is in a pushed position. In this case, it is possible to easily construct the slide restraint unit using the operation lever and the housing.

The guide portion may include a slide operation groove extending in the speed changing direction and a pair of push operation grooves extending in a pushing direction of the operation lever from the opposite ends of the slide operation groove, the slide operation groove and the push operation grooves being continuously formed to have a substantially U-like shape. In this case, it is possible to simplify the configuration of the guide portion using the substantially U-shaped groove.

The push operation grooves may be inclined at an obtuse angle with respect to the slide operation groove. In this case, the operation lever moves, when pushed, in the direction inclined at an obtuse angle with respect to the slide operation groove and not in the direction perpendicular to the slide operation groove. Therefore, the transition from the pushing operation to the sliding operation occurs smoothly, thereby enhancing the operability of the operation lever.

The speed changing unit may further includes a resilient member for biasing the projection portion against the guide portion in a direction to restrain the movement of the operation lever and a restraint releasing unit for moving the projection portion to permit the movement of the operation lever when the operation lever is pushed. In this case, use of the resilient body and the restraint releasing unit makes it possible to bring the operation lever from a movement-restrained state into a movement-permitted state in response to the pushing operation of the operation lever. This ensures that the transition from the pushing operation to the speed-changing sliding operation occurs in a smoother manner.

The operation detector unit may be designed to detect the operation lever when the operation lever is in a generally middle position between a non-pushed position and a pushed position. In this case, if the operation lever is not pushed down by a predetermined amount, the operation detector unit fails to detect the pushing operation of the operation lever. This makes it possible to prevent an erroneous operation of the electric power tool which would otherwise occur when the operation lever is touched inadvertently.

The operation lever may include an interrupter plate having a predetermined length in the speed changing direction, the operation detector unit including a sensor for optically detecting the interrupter plate when the operation lever is pushed. In this case, a single interrupter plate is sufficient to cover a plurality of pushing positions of the operation lever, because the interrupter plate extends in the speed changing direction. This eliminates the need to use sensors in plural numbers, while assuring reduced cost and weight. Use of the non-contact sensor assists in preventing wear of the interrupter plate and prolonging the life span thereof.

The operation lever preferably has an operation surface depressed inwards from an outer surface of the housing. In this case, even if a falling impact force or the like is applied to the operation lever, the housing can first receive the impact force. This is because the operation surface of the operation lever is depressed. Therefore, it is possible to prevent damage of precision electronic parts such as a sensor or a switch arranged below the operation lever.

With the electric power tool of the present invention, the slide restraint unit restrains the sliding operation of the operation lever and makes it impossible to perform a speed changing operation until the pushing operation of the operation lever is detected to control the electric power supplied to the motor. This makes it possible to prevent the electric power tool from suffering from trouble which would otherwise occur due to the wear or damage of gears of the speed reducer unit caused by the speed changing operation performed during the course of work. Furthermore, it is possible to assure enhanced reliability and to reduce the strength required in the gears. Therefore, it becomes possible, for example, to change the material of gears from metal to resin, thereby reducing the cost and weight of the electric power tool.

BRIEF DESCRIPTION OF THE DRAWINGS

The objects and features of the present invention will become apparent from the following description of preferred embodiments, given in conjunction with the accompanying drawings, in which:

FIG. 8A is a perspective view corresponding to FIGS. 5C and 5D, which shows the projection portion moved to a pushed position and kept in a slide-permitted state, FIG. 8B is a section view taken along line G-G in FIG. 8A.

FIGS. 10A and 10B illustrate the projection portion kept in a non-pushed position, i.e., in a slide-restrained state, prior to changing the speed of the electric power tool;

FIGS. 10C and 10D illustrate the projection portion moved to a pushed position and kept in a slide-permitted state prior to changing the speed of the electric power tool;

FIGS. 10E and 10F illustrate the projection portion slidingly operated to finish the speed changing operation;

FIGS. 10G and 10H illustrate the projection portion spring-biased into a non-pushed position and kept in a slide-restrained state after changing the speed of the electric power tool;

DETAILED DESCRIPTION OF THE PREFERRED EMBODIMENTS

Hereinafter, an embodiment of the present invention will be described with reference to the accompanying drawings which form a part hereof.

Figure 1:
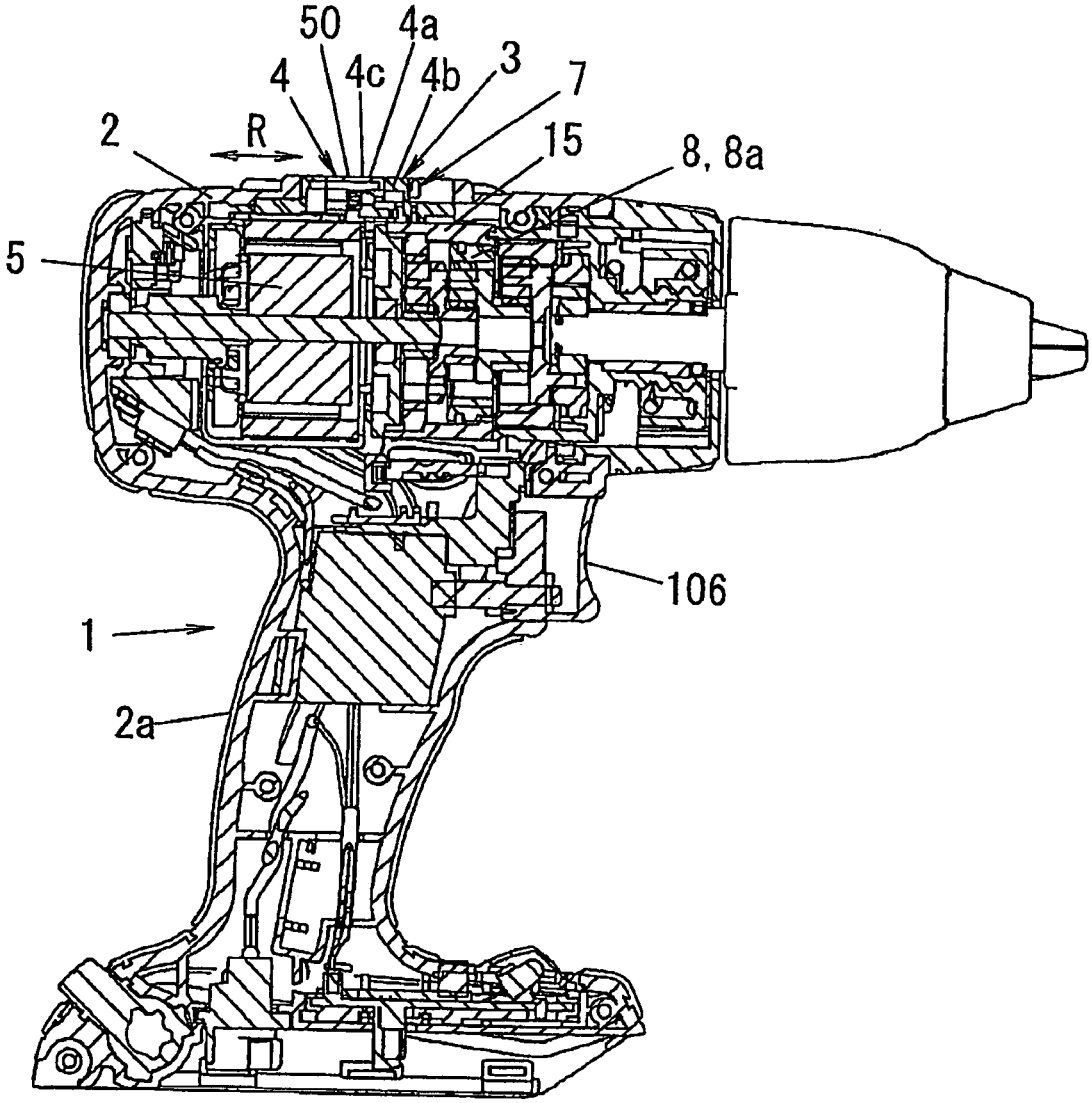
FIG. 1 is a side section view showing an electric power tool in accordance with one embodiment of the present invention.

Referring to FIG. 1, the electric power tool 1 of the present embodiment essentially includes a motor 5 as a driving power source, a speed reducer unit 8 arranged to deliver the rotational power of the motor 5 and provided with two or more gears 8*a*, a driving unit arranged to deliver the rotational power of the speed reducer unit 8 to a tip end tool, a bearing unit for rotatably supporting the driving unit, a housing 2 arranged to accommodate the motor 5, the speed reducer unit 8, the driving unit and the bearing unit therein and provided with a handle portion 2*a*, and a speed changing mechanism 3 for changing the gear reduction ratio of the speed reducer unit 8, the speed changing mechanism 3 being arranged in a position where it can be operated outside the housing 2. In FIG. 1, reference numeral 106 designates a power switch for switching on and off the power supply of the motor 5. A battery pack for supplying electric power to the motor 5 is omitted from illustration.

Figure 3:
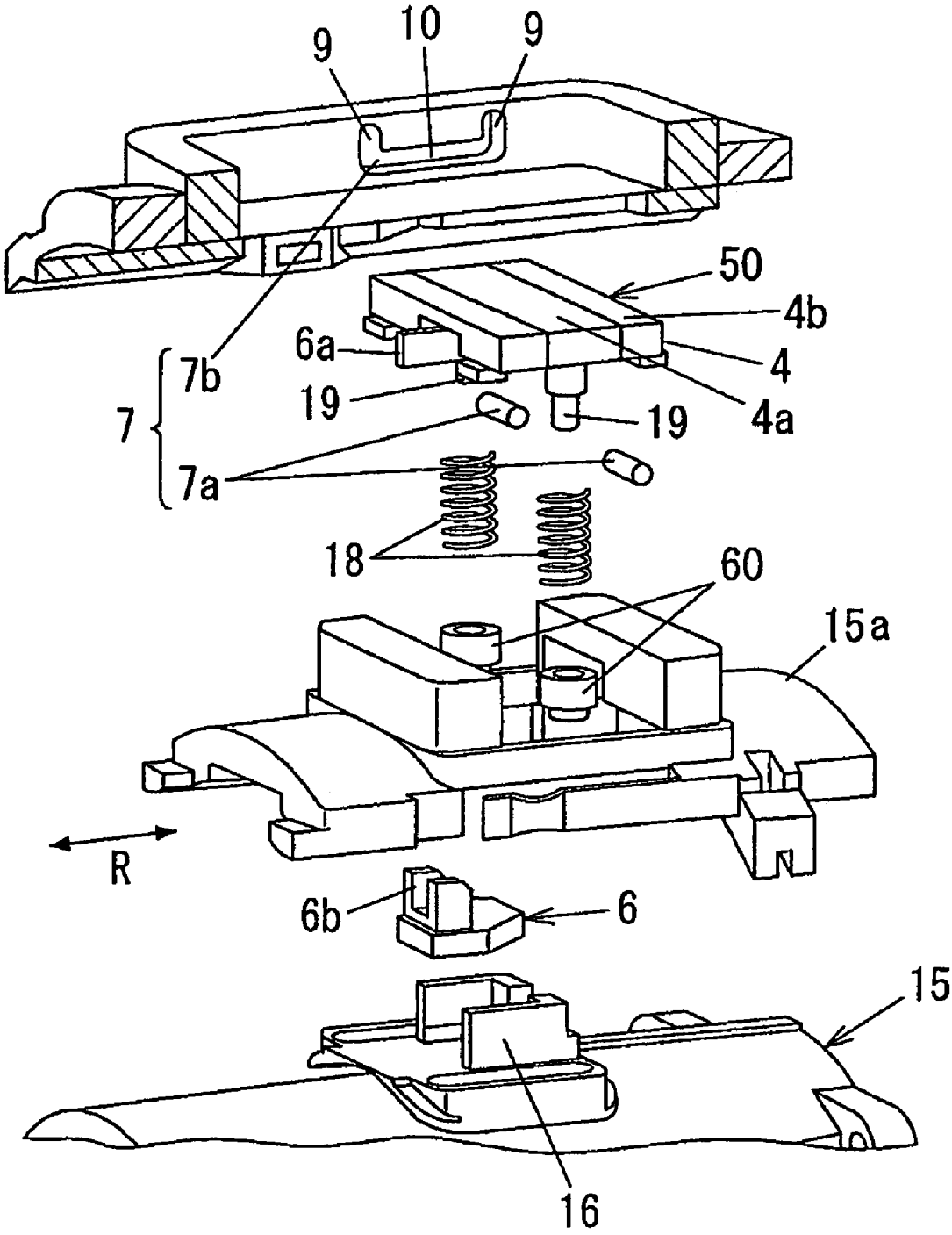
FIG. 3 is an exploded perspective view for explaining the speed changing mechanism employed in the electric power tool.
Figure 4:
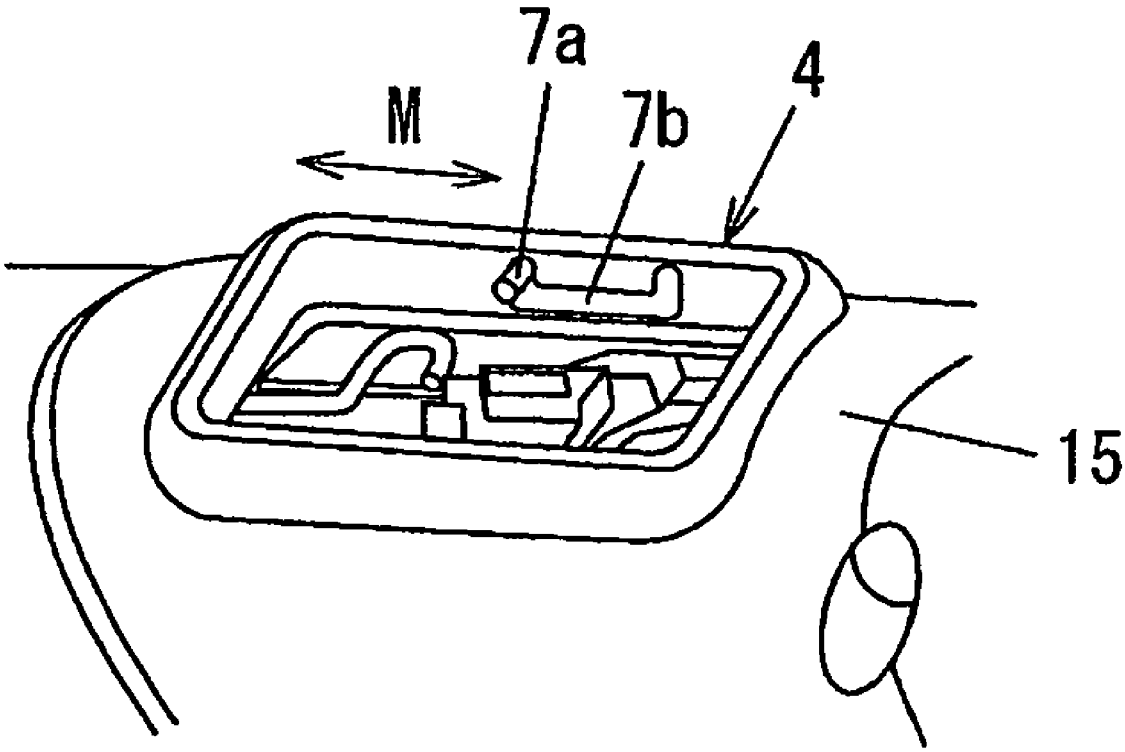
FIG. 4 is a perspective view showing the speed changing mechanism, with an operation lever removed for clarity.
Figure 15:
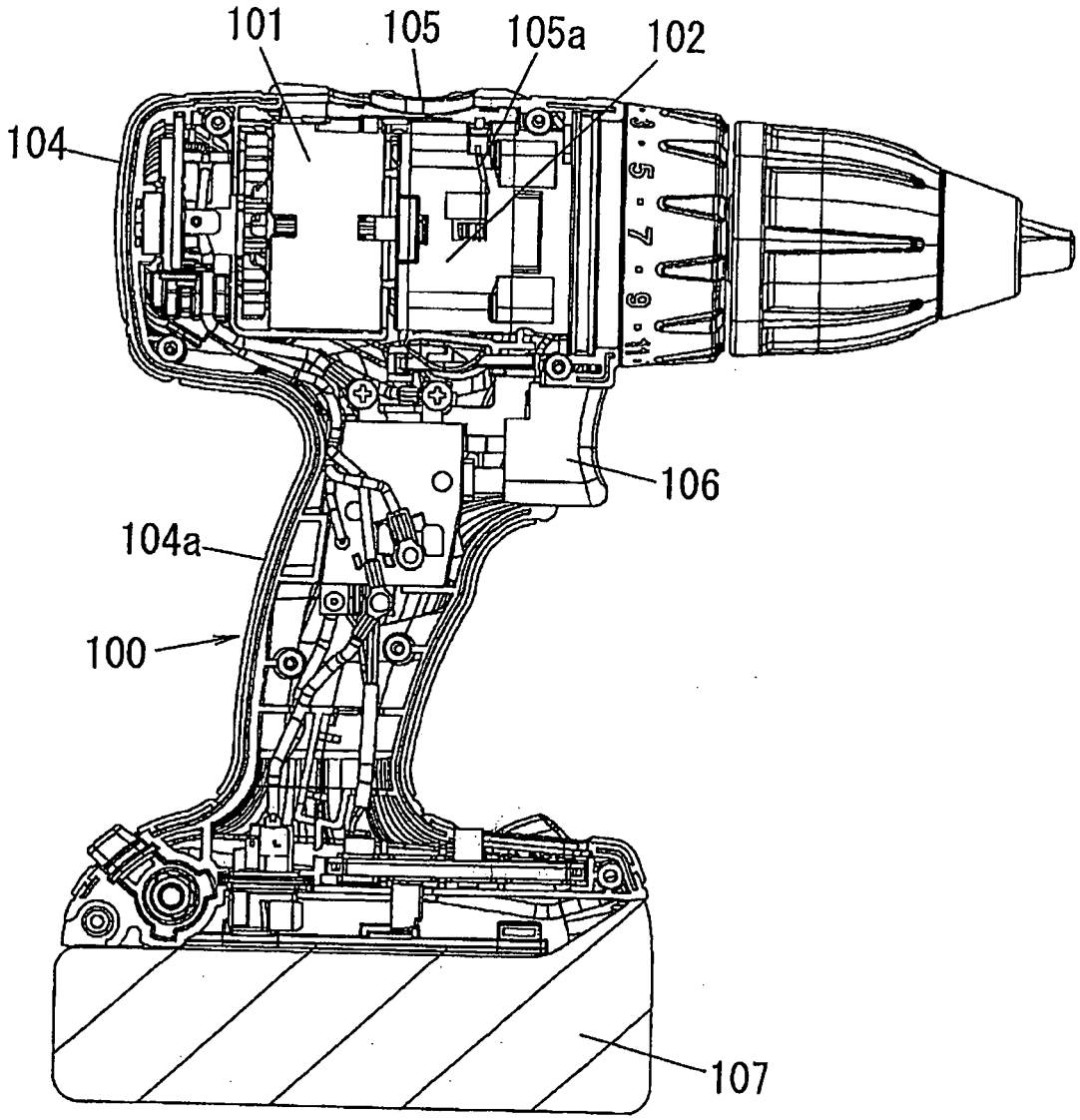
FIG. 15 (PRIOR ART)
FIG. 15 is a side section view showing a conventional electric power tool.
Figure 16A:
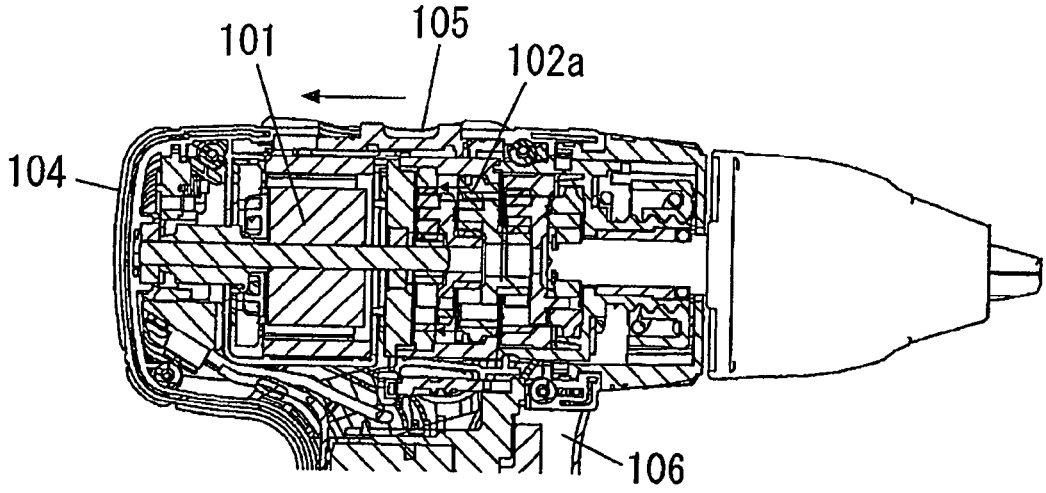
FIG. 16A (PRIOR ART)
FIGS. 16A and 16B are section views for explaining the conventional manner in which the tool operation state is converted from a low-speed high-torque state available in a high load condition (when the work load is heavy) to a high-speed low-torque state available in a low load condition (when the work load is light).
Figure 16B:
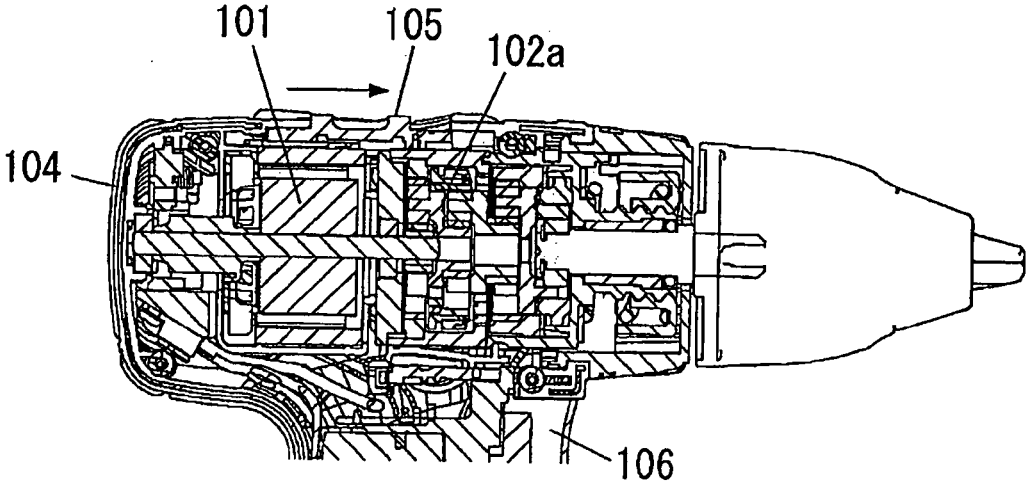
FIG. 16B (PRIOR ART)

The speed changing mechanism 3 is a slide-type operation switch 50 and is divided into an operation lever 4 (an upper layer portion) slidable in a speed changing direction R when in a pushed state and a lower layer portion 15*a* as shown in FIG. 3. The speed changing mechanism 3 includes an operation detector unit 6 for detecting the pushed position of the operation lever 4 and controlling the electric power supplied to the motor 5 so as to rotate the motor 5 at a revolution number corresponding to a gear reduction ratio, a shift unit 105*a* (see FIG. 15) for changing the gear reduction ratio of the speed reducer unit 8 in response to the sliding movement of the operation lever 4, and a slide restraint unit 7 for restraining the sliding operation of the operation lever 4 until the operation detector unit 6 detects the pushed position of the operation lever 4. Reference numeral 15 in the drawings designates a switch base. In the present embodiment, the speed changing direction R coincides with the axial direction of a rotation shaft of the motor 5.

Figure 2:
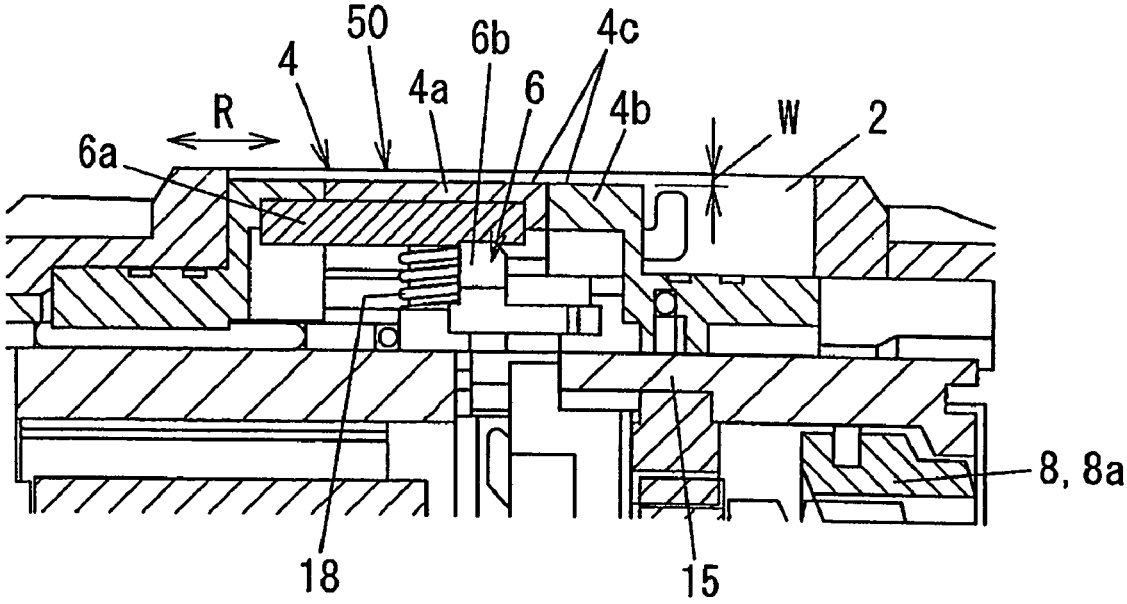
FIG. 2 is an enlarged section view for explaining a speed changing mechanism employed in the electric power tool.
Figure 7A:
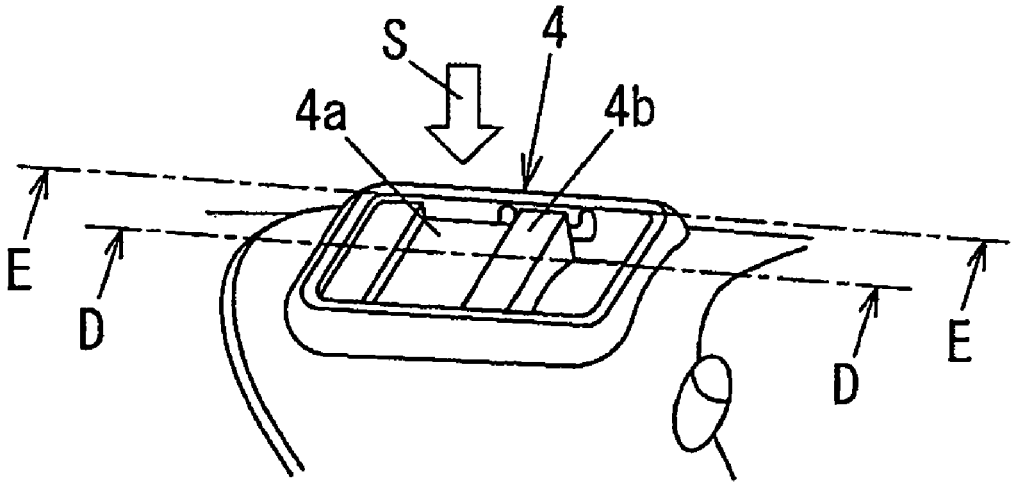
FIG. 7A is a perspective view showing the projection portion pushed to a generally middle position but still kept in a slide-restrained state.
Figure 7B:
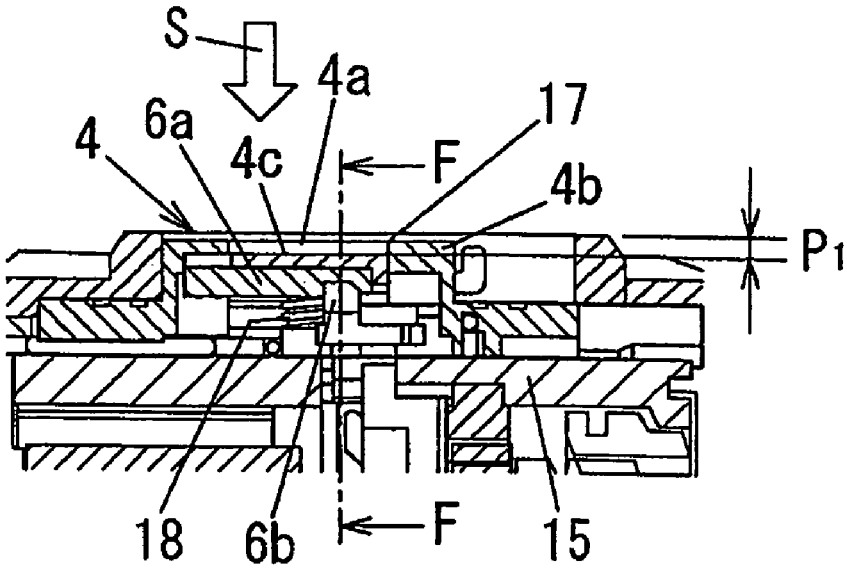
FIG. 7B is a section view taken along line D-D in FIG. 7A.
Figure 7C:
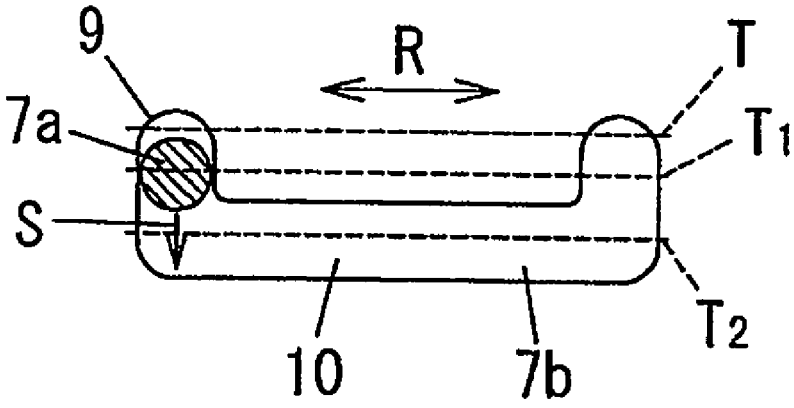
FIG. 7C is a section view taken along line E-E in FIG. 7A.
Figure 7D:
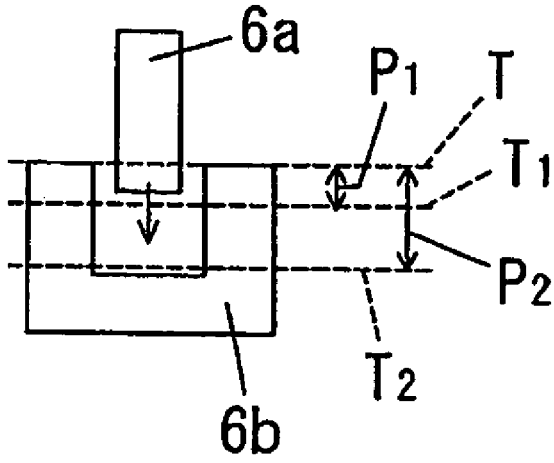
FIG. 7D is a section view taken along line F-F in FIG. 7B.
Figure 8C:
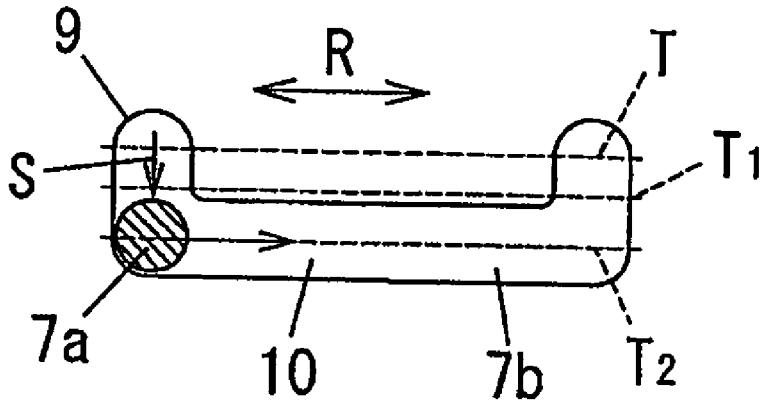
FIG. 8C is a section view taken along line H-H in FIG. 8A.
Figure 8D:
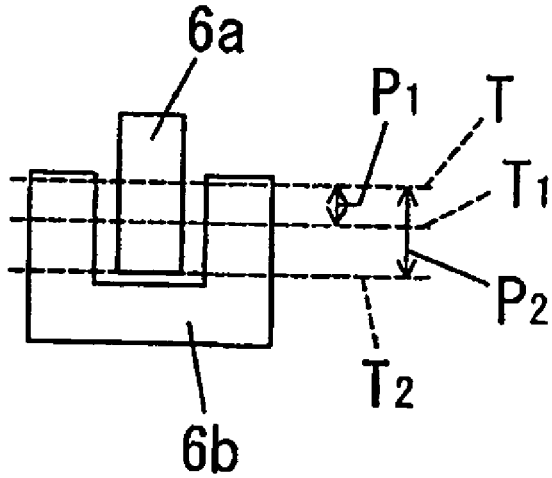
FIG. 8D is a section view taken along line I-I in FIG. 8B.
Figure 9A:
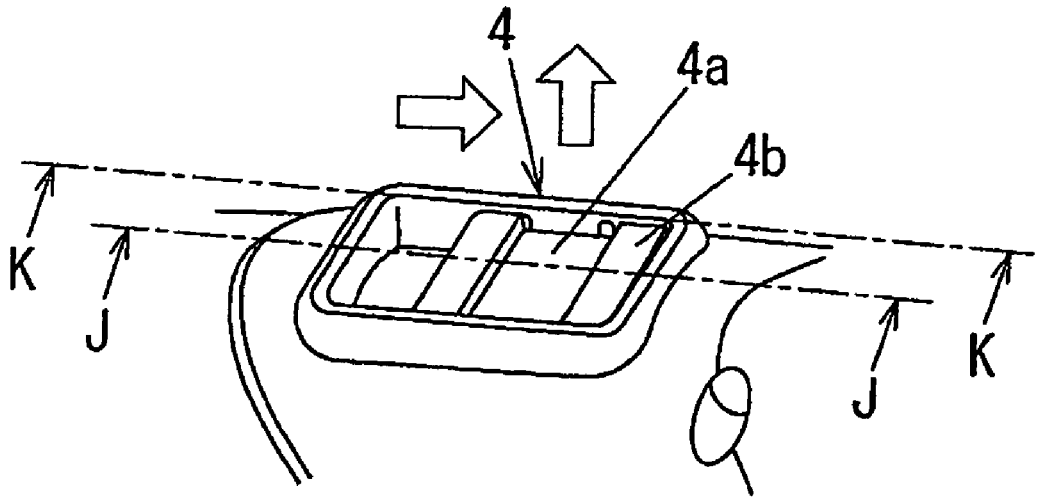
FIG. 9A is a perspective view corresponding to FIGS. 5E and 5F, which shows the projection portion slidingly operated to finish the speed changing operation.
Figure 9B:
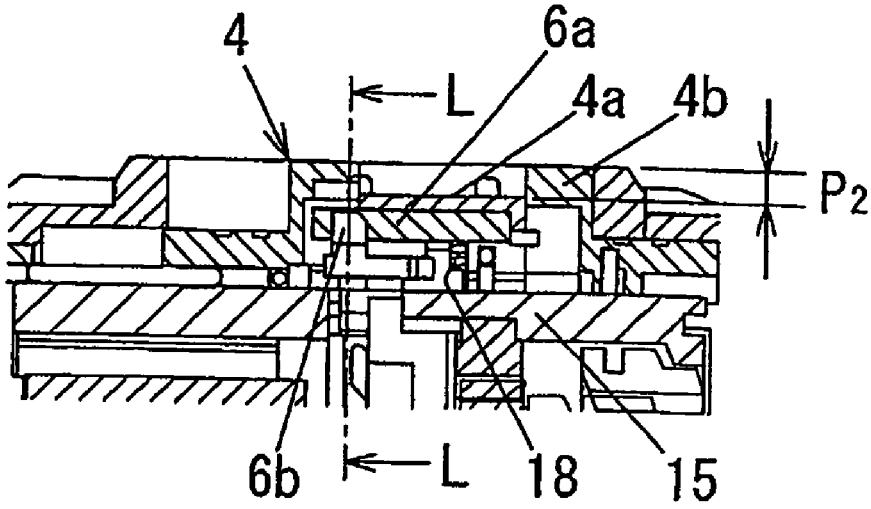
FIG. 9B is a section view taken along line J-J in FIG. 9A.
Figure 9C:
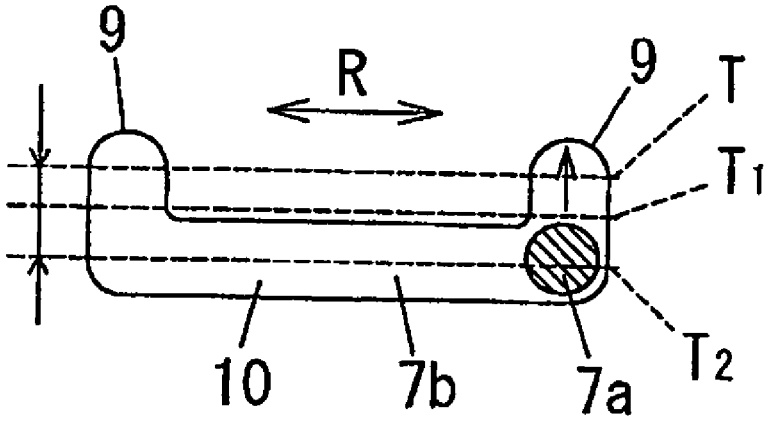
FIG. 9C is a section view taken along line K-K in FIG. 9A.
Figure 9D:
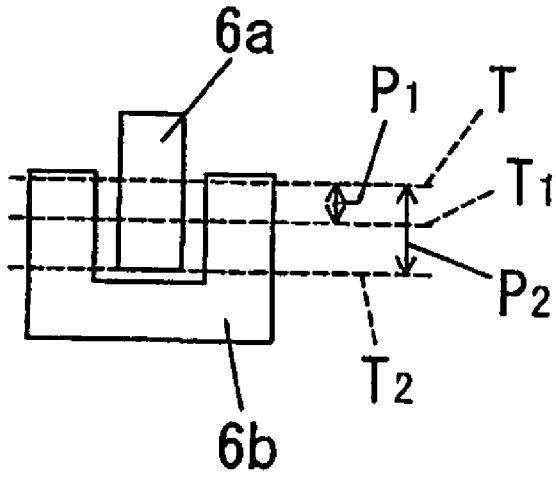
FIG. 9D is a section view taken along line L-L in FIG. 9B.
Figure 10A:
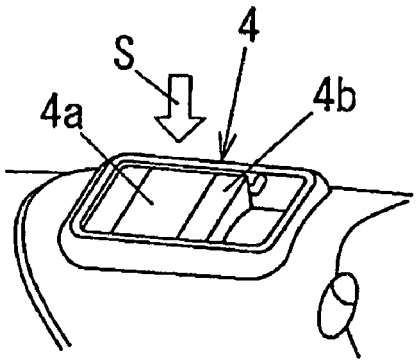
FIGS. 10A through 10H show another example of the guide portion of the speed changing mechanism.
Figure 10B:
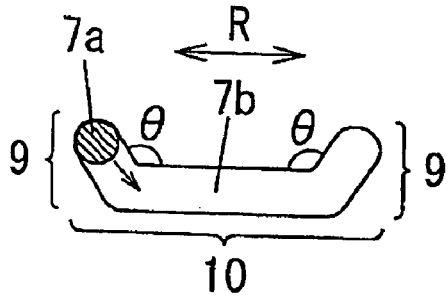
Figure 10C:
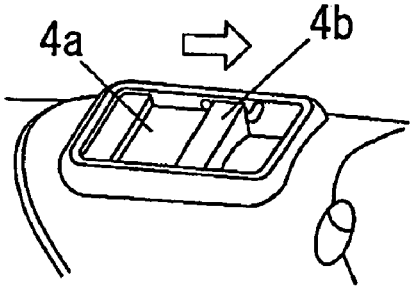
Figure 10D:
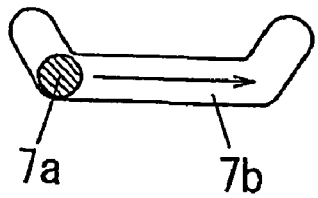
Figure 10E:
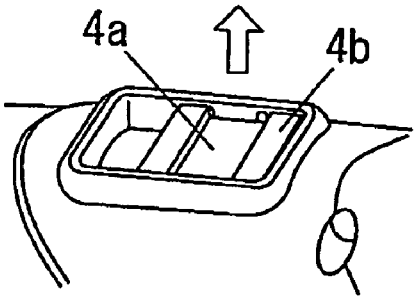
Figure 10F:
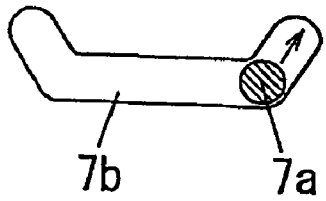
Figure 10G:
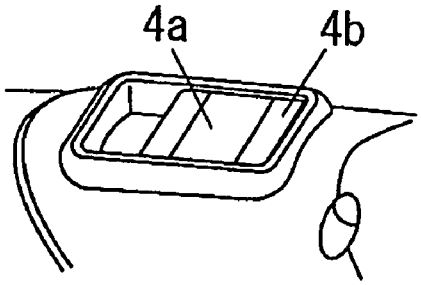
Figure 10H:
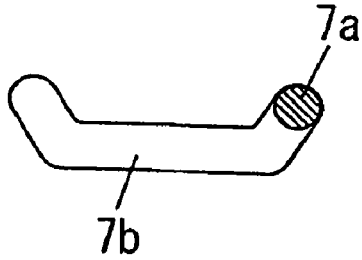

The operation lever 4 is operated forwards and backwards as shown in FIGS. 2 and 3 and includes a slide lever portion 4*b* slidable only in the speed changing direction R and a push lever portion 4*a* that can be pushed downwards relative to the slide lever portion 4*b*. When the slide lever portion 4*b* and the push lever portion 4*a* are slidingly operated by pressing the operation surfaces 4*c* with a finger, only the push lever portion 4*a* is pushed downwards. As a result, a stepped portion 17 (see FIG. 5C and 7B) for making it easy to slide the slide lever portion 4*b* appear at the border between the operation surfaces 4*c*. The push lever portion 4*a* is biased upwards by a switch spring 18. When not pushed, the operation surfaces 4*c* of the operation lever 4, including the slide lever portion 4*b* and the push lever portion 4*a*, are all kept flush. In FIG. 3, reference numeral 19 designates a guide shaft and reference numeral 60 designates a switch spring guide.

An interrupter plate 6*a* serving as a detection plate is installed to protrude downwards from the lower end of the push lever portion 4*a*. The interrupter plate 6*a* extends a predetermined length along the speed changing direction R and has, e.g., opening portions and non-opening portions (not shown) alternately arranged along the longitudinal direction thereof (i.e., the speed changing direction R). In the present embodiment, the operation surfaces 4*c* of the operation lever 4 are depressed a predetermined depth W (see FIG. 2) from the outer surface of the housing 2.

Below the lower layer portion 15*a* of the operation lever 4, a sensor stand 16 for holding a photo interrupter 6*b* of the operation detector unit 6 is attached to the switch base 15. The operation detector unit 6 detects the interrupter plate 6*a* moved down together with the push lever portion 4*a* when the latter is pushed. Using the detection results, the operation detector unit 6 controls the motor 5 in the below-mentioned manner so that the motor 5 can rotate at a revolution number corresponding to the gear reduction ratio.

The slide restraint unit 7 restrains the operation lever 4 from performing the speed changing operation until the pushing operation of the push lever portion 4*a* is detected by the photo interrupter 6*b*. As shown in FIG. 3, the slide restraint unit 7 of the present embodiment includes a pair of projection portions 7*a* provided to the push lever portion 4*a* and a pair of guide portions 7*b* provided on the sliding surfaces of the housing 2 along which the operation lever 4 makes sliding movement. The guide portions 7*b* are configured to guide the projection portions 7*a* in such a manner that they restrain the sliding movement of the projection portions 7*a* in the speed changing direction R when the push lever portion 4*a* is in a non-pushed position T but permits the sliding movement of the projection portions 7*a* in the speed changing direction R when the push lever portion 4*a* is pushed. As shown in FIGS. 4 and 5A through 5H, each of the guide portions 7*b* includes, for example, a slide operation groove 10 extending in the speed changing direction R and a pair of push operation grooves 9 extending in a pushing direction S of the operation lever 4 from the opposite ends of the slide operation groove 10. The slide operation groove 10 and the push operation grooves are continuously formed to have a substantially U-like shape.

Next, description will be made on the operation of the electric power tool.

Figure 5A:
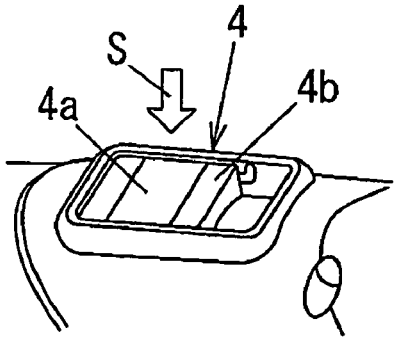
FIGS. 5A and 5B illustrate a projection portion kept in a non-pushed position, i.e., in a slide-restrained state, prior to changing the speed of the electric power tool.
Figure 5B:
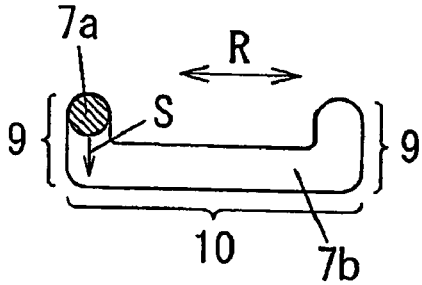
Figure 5C:
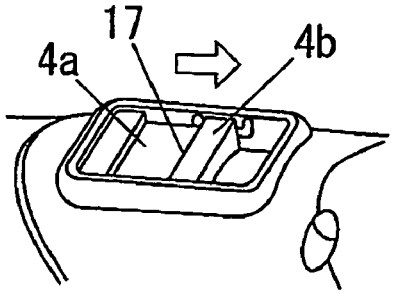
FIGS. 5C and 5D illustrate the projection portion moved to a pushed position and kept in a slide-permitted state prior to changing the speed of the electric power tool.
Figure 5D:
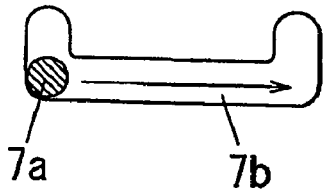
Figure 5E:
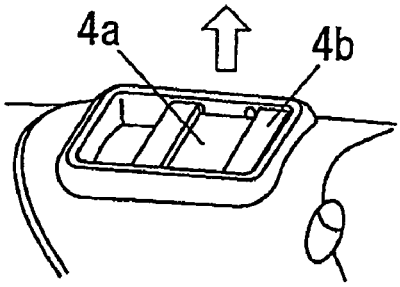
FIGS. 5E and 5F illustrate the projection portion slidingly operated to finish the speed changing operation.
Figure 5F:
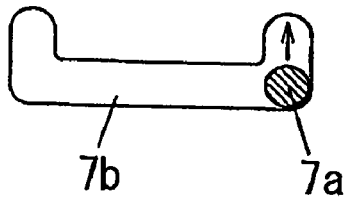
Figure 5G:
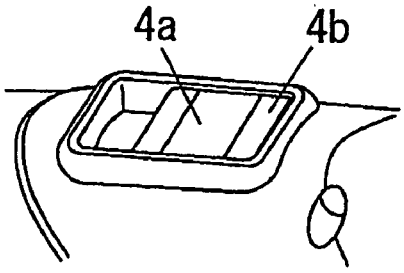
FIGS. 5G and 5H illustrate the projection portion spring-biased into a non-pushed position and kept in a slide-restrained state after changing the speed of the electric power tool.
Figure 5H:
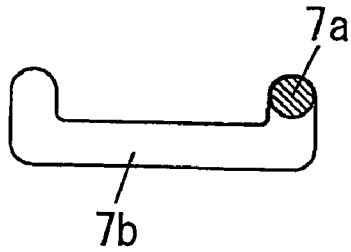
Figure 6A:
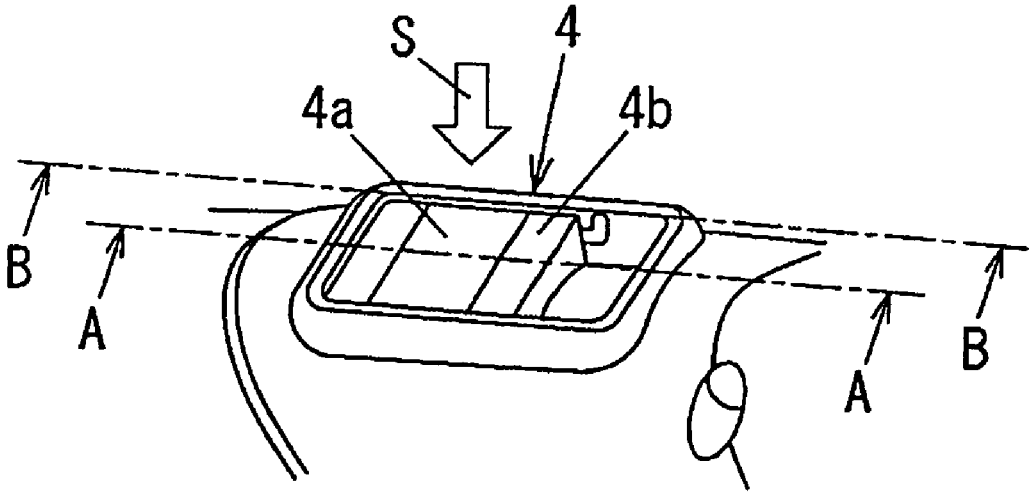
FIG. 6A is a perspective view corresponding to FIGS. 5A and 5B, which shows the projection portion kept in a non-pushed position, i.e., in a slide-restrained state, prior to changing the speed of the electric power tool.
Figure 6B:
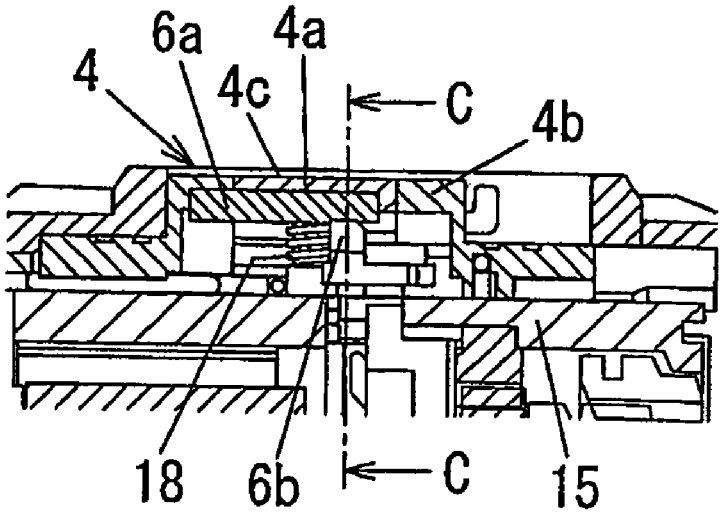
FIG. 6B is a section view taken along line A-A in FIG. 6A.
Figure 6C:
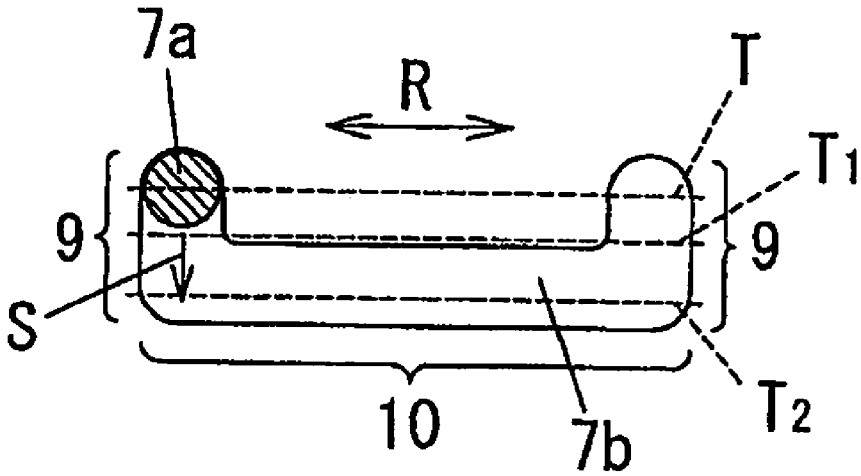
FIG. 6C is a section view taken along line B-B in FIG. 6A.
Figure 6D:
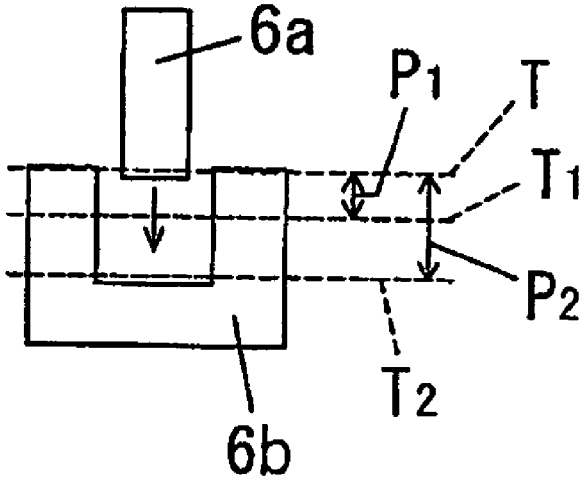
FIG. 6D is a section view taken along line C-C in FIG. 6B.

In order to change the speed of the electric power tool 1, a user slides the operation lever 4 while pushing the same with a finger. In this regard, FIGS. 5A and 5B illustrate the projection portion 7*a* kept in a slide-restrained state prior to changing the speed of the electric power tool 1. FIGS. 5C and 5D illustrate the projection portion 7*a* kept in a slide-permitted state. FIGS. 5E and 5F illustrate the projection portion 7*a* slidingly operated to finish the speed changing operation. FIGS. 5G and 5H illustrate the projection portion 7*a* spring-biased into the non-pushed position T and kept in the slide-restrained state after changing the speed of the electric power tool 1. FIGS. 6A through 6D illustrate the positional relationship between the interrupter plate 6*a* and the photo interrupter 6*b* before the speed changing operation (or after the speed changing operation), which views correspond to FIGS. 5A and 5B (or FIGS. 5G and 5H). In FIGS. 6A through 6D, reference letter "T" indicates the non-pushed position, "T1" indicates the generally middle position where the interrupter plate 6*a* is detectable by the photo interrupter 6*b*, "P1" indicates the push-in amount up to T1, "T2" indicates the pushed position where the sliding movement is permitted, and "P2" indicates the push-in amount up to T2. FIGS. 7A through 7D illustrate a state in which the push lever portion 4*a* is pushed in up to the generally middle position T1 where the interrupter plate 6*a* is detectable by the photo interrupter 6*b*. FIGS. 8A through 8D illustrate a state in which the push lever portion 4*a* is pushed into a position where the sliding movement is permitted. FIGS. 9A through 9D illustrate the positional relationship between the interrupter plate 6*a* and the photo interrupter 6*b* after the speed changing operation, which views correspond to FIGS. 5E and 5F.

If the push lever portion 4*a* of the operation lever 4 is pushed as shown in FIGS. 5A and 5B, the projection portion 7*a* is moved down along the push operation groove 9. The movement of the projection portion 7*a* into the slide operation groove 10 is restrained when the push lever portion 4*a* is in the generally middle position T1. This makes it impossible to change the speed of the electric power tool 1. In the generally middle position T1, the interrupter plate 6*a* is detected by the photo interrupter 6*b*. For example, by sensing one of the opening portions and non-opening portions of the interrupter plate 6*a*, the photo interrupter 6*b* detects whether the operation lever 4 is in a high-speed state or a low-speed state. Using this detection result, a control unit (not shown) controls the electric power supplied to the motor 5. When the high-speed state is detected, the motor 5 is converted from high speed rotation to low speed rotation. In contrast, when the low-speed state is detected, the motor 5 is converted from low speed rotation to high speed rotation. After the push lever portion 4*a* is pushed into the pushed position T2 to permit sliding movement, the operation lever 4 including the push lever portion 4*a* and the slide lever portion 4*b* is slidingly operated to perform the speed changing operation. When performing the speed changing operation, the motor 5 is already driven at a revolution number corresponding to the gear reduction ratio as mentioned above. Therefore, it is possible to prevent the gears of the speed reducer unit 8 from being worn or damaged by the mutual collision during their rotation, thereby avoiding occurrence of problems or trouble which would otherwise be caused by the speed changing operation performed during the course of work.

With the configuration stated above, the slide restraint unit 7 restrains the sliding movement of the operation lever 4 and makes it impossible to perform the speed changing operation until the pushing operation of the push lever portion 4*a* of the operation lever 4 is detected by the operation detector unit 6. As a result, the operation detector unit 6 performs its detection task in a reliable manner and the electric power supplied to the motor 5 is controlled so that the motor 5 can rotate at the revolution number corresponding to the gear reduction ratio. Therefore, it becomes possible to prevent the electric power tool from suffering from trouble which would otherwise occur due to the wear or damage of the gears 8*a* of the speed reducer unit 8 caused by the speed changing operation performed during the course of work. Furthermore, it is possible to assure enhanced reliability and to reduce the strength required in the gears 8*a* of the speed reducer unit 8. Therefore, it becomes possible, for example, to change the material of the gears 8*a* from metal to resin. This eliminates the need to make the gears 8*a* from high strength metal or to increase the size of the gears 8*a*, eventually making it possible to avoid an increase in the cost and weight of the electric power tool 1.

The photo interrupter 6*b* detects the push lever portion 4*a* when the latter is in the generally middle position T1. In other words, the photo interrupter 6*b* does not detect the push lever portion 4*a* unless the latter is pushed down by a predetermined amount. This makes it possible to prevent an erroneous operation of the electric power tool which would otherwise occur when the push lever portion 4*a* is touched inadvertently. Owing to the fact that the interrupter plate 6*a* extends in the speed changing direction R, a single interrupter plate is sufficient to cover a plurality of pushing positions T2 of the push lever portion 4*a*. This eliminates the need to use a sensor, e.g., the photo interrupter 6*b*, in plural numbers, while assuring reduced cost and weight. Use of the non-contact sensor assists in preventing wear of the interrupter plate 6*a* and prolonging the life span thereof. Since the photo interrupter 6*b* is a non-contact sensor, it can be used for a long period of time. In addition, the lead wire through which to send a detection signal from the sensor to a power supply circuit of the motor 5 is kept stationary regardless of the operation of the operation lever 4. This reduces the probability that the lead wire is flexed and eventually disconnected, thereby making it possible to increase reliability.

The slide restraint unit 7 of the present embodiment includes the projection portions 7*a* provided to the push lever portion 4*a* of the operation lever 4 and the guide portions 7*b* provided in the housing 2. This makes it possible to easily construct slide restraint unit 7 by using the operation lever 4 and the housing 2. Furthermore, each of the guide portion 7*b* includes the slide operation groove 10 extending in the speed changing direction R and the pair of push operation grooves 9 extending in the pushing direction S from the opposite ends of the slide operation groove 10. The slide operation groove 10 and the push operation grooves are continuously formed to have a substantially U-like shape. This makes it possible simplify the configuration of the guide portion 7*b*. In addition, since the guide portions 7*b* are provided in the housing 2 and the projection portions 7*a* are provided to the operation lever 4, it is possible to reduce the size of the slide-type operation switch 50.

There may be a fear that the precision electronic parts (e.g., the sensor such as the photo interrupter 6*b* or the like and the switch such as the operation detector unit 6 or the like) arranged just below the operation lever 4 are damaged if a falling impact force or the like is applied to the operation lever 4. In the present embodiment, the operation surfaces 4*c* of the operation lever 4 are depressed by a predetermined depth W (see FIG. 2). Therefore, the housing 2 can first receive the impact force. This makes it possible to prevent damage of the sensor.

FIGS. 10A through 10H show another example of the substantially U-shaped grooves of the guide portion 7*b*. In this example, a pair of push operation grooves 9 is inclined at an obtuse angle θ with respect to a slide operation groove 10. The remaining structures are the same as those of the embodiment shown in FIGS. 1 through 3. In this example, the push operation grooves 9 extend continuously from the slide operation groove 10 in an upwardly diverging shape. As a result, when the push lever portion 4*a* is pushed, it does not move down vertically but moves obliquely toward the slide operation groove 10. Therefore, the transition from the pushing operation to the sliding operation occurs smoothly, thereby enhancing the operability of the operation lever 4.

Figure 11A:
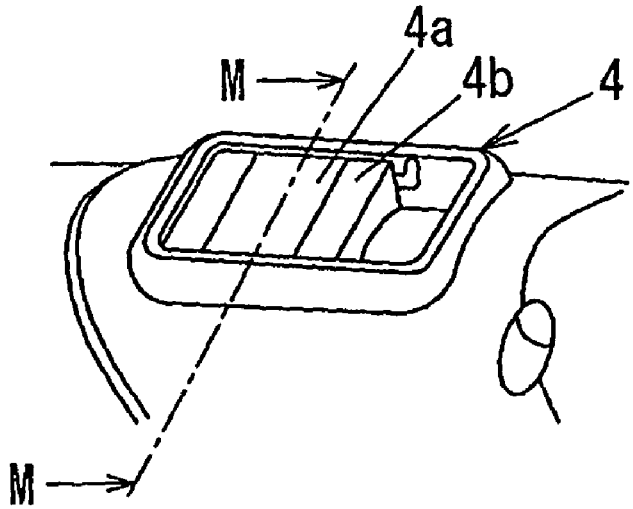
FIG. 11A is a perspective view showing another example of the slide restraint unit.
Figure 11B:
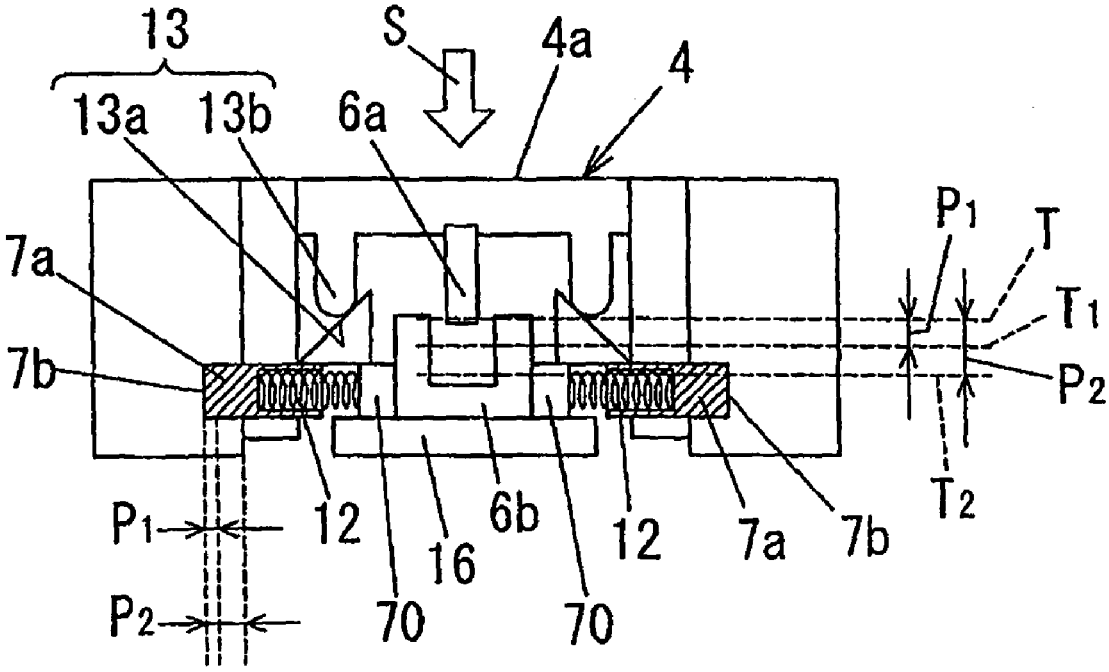
FIG. 11B is a section view taken along line M-M in FIG. 11A.

FIGS. 11A, 11B, 12A, 12B, 13A and 13B show another example of the guide portion 7*b*. In this example, there are provided resilient bodies 12 for biasing the projection portions 7*a* in a movement-restraining direction relative to the guide portions 7*b* and restraint releasing units 13 for biasing the projection portions 7*a* in a movement-permitting direction relative to the guide portions 7*b* when the operation lever 4 is pushed. The remaining structures are the same as those of the embodiment shown in FIGS. 1 through 3. In this example, a pair of left and right projection portions 7*a* is arranged on the opposite sides of the sensor stand 16 as shown in FIG. 11B. The projection portions 7*a* have the same structure. Coil springs as the resilient bodies 12 protrude from the inner ends of the projection portions 7*a*. The sensor stand 16 has spring rests 70 arranged to support the tip ends of the coil springs. Triangular lug portions protrude upwards from the inner upper surfaces of the projection portions 7*a*. Each of the lug portions has an outer tapering surface 13*a*. Restraint releasing arms 13*b* extend downwards from the lower opposite side surfaces of the push lever portion 4*a*. The restraint releasing arms 13*b* and the tapering surfaces 13*a* of the lug portions constitute the restraint releasing units 13.

Figure 12A:
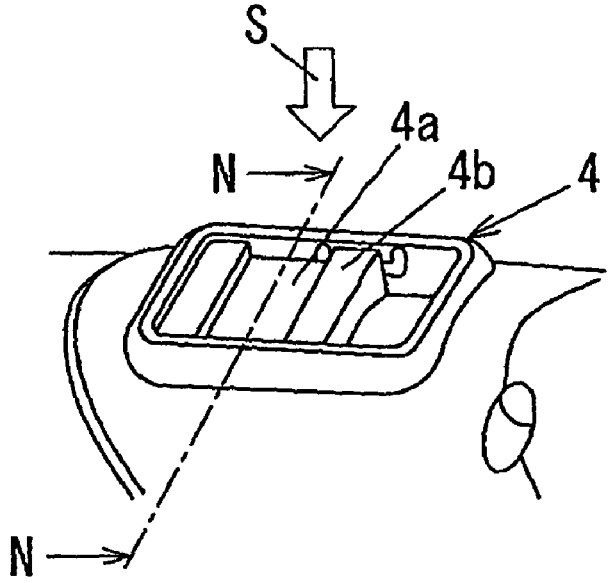
FIG. 12A is a perspective view showing the slide restraint unit, with the push lever portion moved from the position shown in FIGS. 11A and 11B to a generally middle position.
Figure 12B:
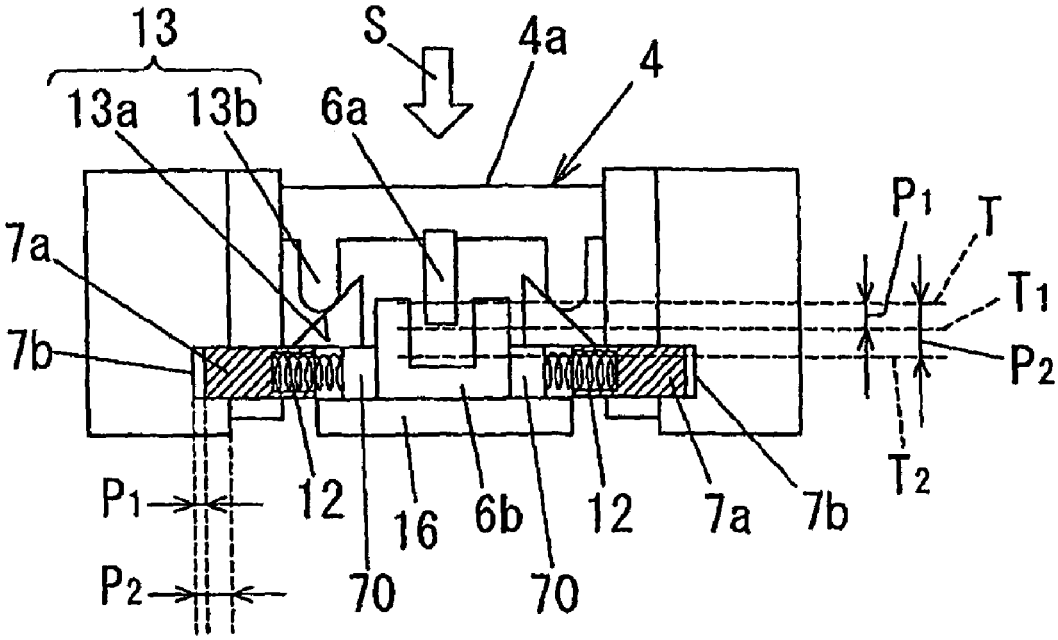
FIG. 12B is a section view taken along line N-N in FIG. 12A.
Figure 13A:
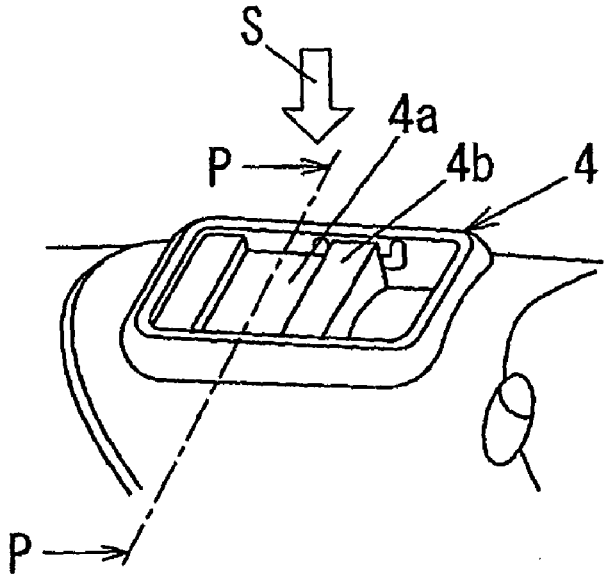
FIG. 13A is a perspective view showing the slide restraint unit, with the push lever portion moved from the position shown in FIGS. 11A and 11B to a pushed position.
Figure 13B:
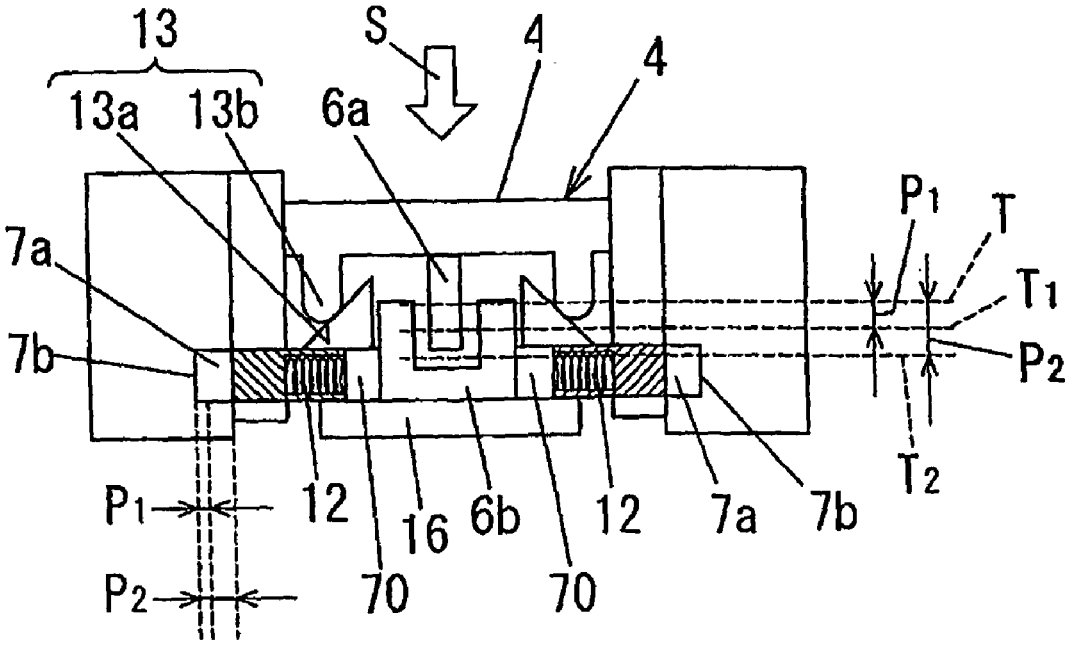
FIG. 13B is a section view taken along line P-P in FIG. 13A.

When the operation lever 4 of this example is in the non-pushed position T, the projection portions 7*a* are resiliently pressed against the guide portions 7*b* by the coil springs as shown in FIG. 11B, thus restraining the sliding movement of the operation lever 4. If the push lever portion 4*a* of the operation lever 4 is pushed, the restraint releasing arms 13*b* are slidingly moved down over the tapering surfaces 13*a* of the projection portions 7*a*. Thus the projection portions 7*a* move away from the guide portions 7*b*. If the push lever portion 4*a* reaches the generally middle position T1 as shown in FIG. 12B, the interrupter plate 6*a* is detected by the photo interrupter 6*b*. When the push lever portion 4*a* is further pushed into the pushed position T2 as shown in FIG. 13B, the sliding movement of the projection portions 7*a* relative to the guide portions 7*b* is permitted so that the speed changing operation can be performed by slidingly operating the operation lever 4. As set forth above, the slide restraint unit 7 of this example is capable of bringing the projection portions 7*a* from a movement-restrained state into a movement-permitted state in response to the pushing operation of the push lever portion 4*a* of the operation lever 4. This ensures that the transition from the pushing operation to the speed-changing sliding operation occurs in a smoother manner. Another advantage resides in that it is possible to easily construct the slide restraint unit 7 using the coil spring-biased projection portions 7*a* provided in the operation lever 4 and the guide portions 7*b* provided in the housing 2.

Figure 14A:
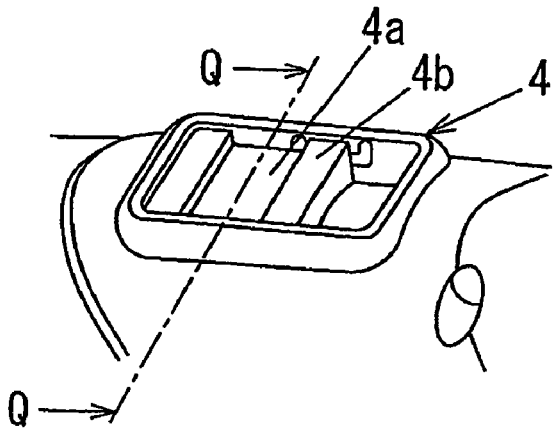
FIG. 14A is a perspective view showing still another example of the slide restraint unit.
Figure 14B:
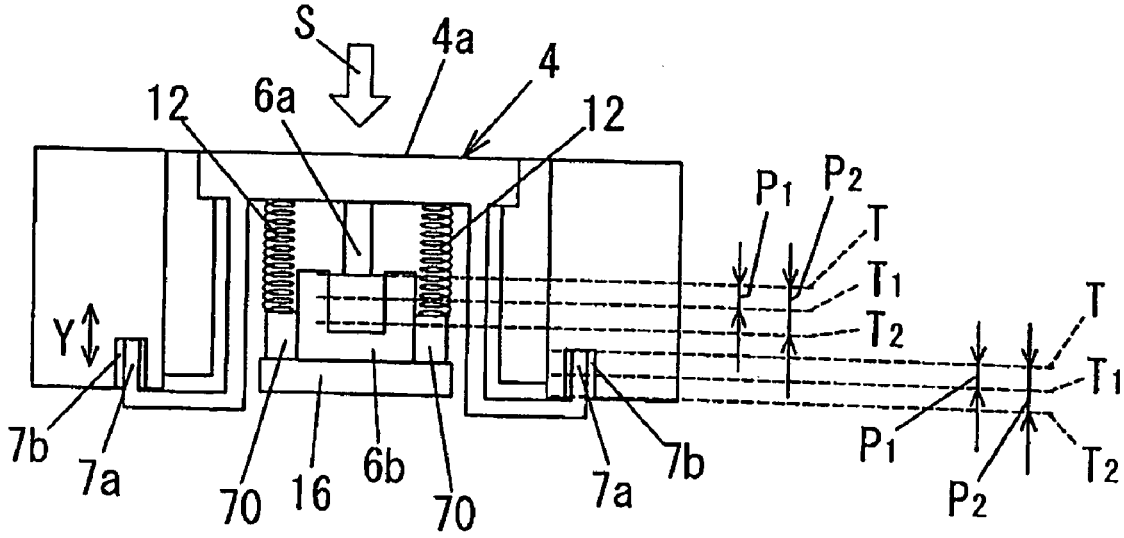
FIG. 14B is a section view taken along line Q-Q in FIG. 14A.

FIGS. 14A and 14B show an example in which the guide portions 7*b* include grooves cut in the radial direction (i.e., the thickness direction) Y of the housing 2. As is the case in FIGS. 4 and 6A through 6D, these grooves have a substantially U-like shape when seen from the inside of the housing 2 and are opened downwards. The remaining structures are the same as those of the embodiment shown in FIGS. 1 through 3. In this example, projection portions 7*a* protrude from the left and right end regions of the push lever portion 4*a*. Each of the projection portions 7*a* are formed into a generally L-like shape. The tip ends of the projection portions 7*a* are inserted into the downwardly-opened guide portions 7*b* of the housing 2. The sensor stand 16 includes spring rests 70 provided at the left and right sides thereof. Coil springs as resilient bodies 12 for biasing the projection portions 7*a* in a movement-restraining direction with respect to the guide portions 7*b* are retained between the spring rests 70 and the lower surface of the push lever portion 4*a*. When the operation lever 4 of this example is in the non-pushed position T, the projection portions 7*a* are resiliently pressed against the guide portions 7*b* by the coil springs as shown in FIG. 14B, thus restraining the sliding movement of the operation lever 4. If the push lever portion 4*a* of the operation lever 4 is pushed, the coil springs are compressed and the tip ends of the projection portions 7*a* are moved away from the guide portions 7*b*. When the push lever portion 4*a* is in the generally middle position T1, the interrupter plate 6*a* is detected by the photo interrupter 6*b*. If the push lever portion 4*a* reaches the pushed position T2, the sliding movement of the projection portions 7*a* relative to the guide portions 7*b* is permitted so that the speed changing operation can be performed by slidingly operating the operation lever 4.

As set forth above, the slide restraint unit 7 of this example is capable of bringing the projection portions 7*a* from a movement-restrained state into a movement-permitted state in response to the pushing operation of the push lever portion 4*a* of the operation lever 4. This ensures that the transition from the pushing operation to the speed-changing sliding operation occurs in a smoother manner. Furthermore, it is possible to easily construct the slide restraint unit 7 using the projection portions 7*a* and the resilient bodies 12 provided to the operation lever 4 and the guide portions 7*b* provided in the housing 2. Owing to the fact that the guide portions 7*b* are formed to extend in the radial direction (i.e., the thickness direction), it becomes easy to reduce the circumferential size of the housing 2. Since the guide portions 7*b* are opened downwards, it is possible to prevent dust from gathering in the guide portions 7*b*.

Although the operation lever 4 is divided into the slide lever portion 4*b* and the push lever portion 4*a* and only the push lever portion 4*a* is pushed according to the foregoing embodiment, the present invention is not limited thereto. Alternatively, the operation lever 4 may be formed into a single piece so that the sliding operation can be performed while pushing the operation lever 4 as a whole.

Although the photo interrupter 6*b* is used as the operation detector unit 6 and the interrupter plate 6*a* is used as the detected plate according to the foregoing embodiment, other sensors such as a magnetic sensor and the like may be used instead of the combination of the photo interrupter 6*b* and the interrupter plate 6*a*. As a further alternative, it may be possible to use a typical mechanical contact switch, e.g., a tact switch, a limit switch or a micro switch.

Although the speed changing direction R is the back-and-forth direction parallel to the axial direction D of the rotation shaft of the motor 5 according to the foregoing embodiment, the present invention is not limited thereto. As an alternative example, the speed changing direction R may be the left-and-right direction perpendicular to the rotation shaft of the motor 5. In this case, the guide portion 7*b* may be a substantially U-shaped groove extending in the circumferential direction of the housing 2. This assists in reducing the radial size of the housing 2.

While the invention has been shown and described with respect to the preferred embodiments, it will be understood by those skilled in the art that various changes and modification may be made without departing from the scope of the invention as defined in the following claims.

What is claimed is:

1. An electric power tool comprising:

a motor as a driving power source for generating rotational power;

a speed reducer unit arranged to deliver the rotational power of the motor and provided with two or more gears;

a driving unit arranged to deliver the rotational power from the speed reducer unit to a tip end tool;

a housing arranged to accommodate the motor, the speed reducer unit and the driving unit therein and provided with a handle portion; and a speed changing unit for changing a gear reduction ratio of the speed reducer unit, the speed changing unit arranged in such a position as to be operable outside the housing, wherein the speed changing unit comprises an operation lever slidingly operable in a sliding direction when pushed, a power control unit for detecting that the operation lever is pushed by a threshold amount and changing electric power supplied to the motor when the operation lever is pushed by the threshold amount, a shift unit for changing the gear reduction ratio of the speed reducer unit in response to a sliding movement of the operation lever, and a slide restraint unit for restraining the sliding movement of the operation lever until the power control unit detects that the operation lever is pushed by the threshold amount, and wherein the slide restraint unit includes a projection portion provided in one of mutually facing surfaces of the operation lever and the housing and a guide portion provided in the other surface, the projection portion and the guide portion being configured in such a manner as to restrain the sliding movement of the operation lever in the sliding direction when the operation lever is in a non-pushed position but permit the sliding movement of the operation lever in the sliding direction when the operation lever is in a pushed position.

2. The electric power tool of claim 1, wherein the guide portion includes a slide operation groove extending in the sliding direction and a pair of push operation grooves extending in a pushing direction of the operation lever from the opposite ends of the slide operation groove, the slide operation groove and the push operation grooves being continuously formed to have a generally square bracket shape.

3. The electric power tool of claim 2, wherein the push operation grooves are inclined at an obtuse angle with respect to the slide operation groove.

4. The electric power tool of claim 1, wherein the speed changing unit further comprises a resilient member for biasing the projection portion against the guide portion in a direction to restrain the sliding movement of the operation lever and a restraint releasing unit for moving the projection portion to permit the sliding movement of the operation lever when the operation lever is pushed.

5. The electric power tool of claim 1, wherein the projection portion is provided to the operation lever and the guide portion is provided to the housing.

6. The electric power tool of claim 1, wherein the operation lever is in a generally middle position between the non-pushed position and the pushed position when the operation lever is pushed by the threshold amount.

7. The electric power tool of claim 2, wherein the operation lever has an operation surface depressed inwards from an outer surface of the housing.

8. An electric power tool comprising:

a motor as a driving power source for generating rotational power;

a speed reducer unit arranged to deliver the rotational power of the motor and provided with two or more gears;

a driving unit arranged to deliver the rotational power from the speed reducer unit to a tip end tool;

a housing arranged to accommodate the motor, the speed reducer unit and the driving unit therein and provided with a handle portion; and a speed changing unit for changing a gear reduction ratio of the speed reducer unit, the speed changing unit arranged in such a position as to be operable outside the housing, wherein the speed changing unit comprises an operation lever slidingly operable in a sliding direction when pushed, a power control unit for detecting that the operation lever is pushed by a threshold amount and changing electric power supplied to the motor when the operation lever is pushed by the threshold amount, a shift unit for changing the gear reduction ratio of the speed reducer unit in response to a sliding movement of the operation lever, and a slide restraint unit for restraining the sliding movement of the operation lever until the power control unit detects that the operation lever is pushed by the threshold amount, wherein an interrupter plate having a predetermined length in the sliding direction is attached to the operation lever, and wherein the power control unit includes a sensor for optically detecting the interrupter plate when the operation lever is pushed by the threshold amount.

9. An electric power tool comprising:

a motor as a driving power source for generating rotational power;

a speed reducer unit arranged to deliver the rotational power of the motor and provided with two or more gears;

a driving unit arranged to deliver the rotational power from the speed reducer unit to a tip end tool;

a housing arranged to accommodate the motor, the speed reducer unit and the driving unit therein and provided with a handle portion; and a speed changing unit for changing a gear reduction ratio of the speed reducer unit, the speed changing unit arranged in such a position as to be operable outside the housing, wherein the speed changing unit comprises an operation lever slidingly operable in a sliding direction when pushed, a power control unit for detecting that the operation lever is pushed by a threshold amount and changing electric power supplied to the motor when the operation lever is pushed by the threshold amount, a shift unit for changing the gear reduction ratio of the speed reducer unit in response to a sliding movement of the operation lever, and a slide restraint unit for restraining the sliding movement of the operation lever until the power control unit detects that the operation lever is pushed by the threshold amount, and wherein the power control unit changes the electric power supplied to the motor so that the motor can rotate at a revolution per minute corresponding to the gear reduction ratio.

10. An electric power tool comprising:

a motor as a driving power source for generating rotational power;

a speed reducer unit arranged to deliver the rotational power of the motor and provided with two or more gears;

a driving unit arranged to deliver the rotational power from the speed reducer unit to a tip end tool;

a housing arranged to accommodate the motor, the speed reducer unit and the driving unit therein and provided with a handle portion; and a speed changing unit for changing a gear reduction ratio of the speed reducer unit, the speed changing unit being arranged in such a position as to be operable from the outside of the housing, wherein the speed changing unit comprises an operation lever slidingly operable in a sliding direction when pushed by a first amount, a power control unit for detecting that the operation lever is pushed by a second amount and changing electric power supplied to the motor when the operation lever is pushed by the second amount, a shift unit connected to the operation lever for changing the gear reduction ratio of the speed reducer unit in response to a sliding movement of the operation lever, and a slide restraint unit for preventing the sliding movement of the operation lever until the operation lever is pushed by a first amount, wherein the first amount is greater than the second amount, so that the electric power supplied to the motor is changed before the gear reduction ratio is changed by the shift unit.

11. The electric power tool of claim 10, wherein the slide restraint unit includes a projection portion provided in one of mutually facing surfaces of the operation lever and the housing and a guide portion provided in the other surface, the projection portion and the guide portion being configured in such a manner as to permit the sliding movement of the operation lever in the sliding direction when the operation lever is in a pushed by the first amount.

12. The electric power tool of claim 11, wherein the guide portion includes a slide operation groove extending in the sliding direction and a pair of push operation grooves extending in a pushing direction of the operation lever from the opposite ends of the slide operation groove, the slide operation groove and the push operation grooves being continuously formed to have a generally square bracket shape.

13. The electric power tool of claim 12, wherein the push operation grooves are inclined at an obtuse angle with respect to the slide operation groove.

14. The electric power tool of claim 11, wherein the speed changing unit further comprises a resilient member for biasing the projection portion against the guide portion in a direction to prevent the sliding movement of the operation lever and a restraint releasing unit for moving the projection portion to permit the sliding movement of the operation lever when the operation lever is pushed by the first amount.

15. The electric power tool of claim 11, wherein the projection portion is provided to the operation lever and the guide portion is provided to the housing.

16. The electric power tool of claim 10, wherein the operation lever is in a generally middle position between a non-pushed position and a pushed position when the operation lever is pushed by the second amount.

17. The electric power tool of claim 10, wherein an interrupter plate having a predetermined length in the sliding direction is attached to a lower portion of the operation lever, and wherein the power control unit includes a sensor for optically detecting the interrupter plate when the operation lever is pushed by the second amount.

18. The electric power tool of claim 17, wherein the interrupter plate is provided with opening portions and non-opening portions alternately arranged along the sliding direction.

19. The electric power tool of claim 10, wherein an entire upper surface of the operation lever is depressed inwards from an outer surface of the housing.

* * * * *